United States Patent [19]

Carter

[11] Patent Number: 4,982,455

[45] Date of Patent: Jan. 8, 1991

[54] AUTOMATICALLY CONCEALED URINAL

[76] Inventor: Marjorie H. Carter, P.O. Box 170625, San Francisco, Calif. 94117

[21] Appl. No.: 193,095

[22] Filed: May 12, 1988

[51] Int. Cl.[5] ..... E03D 13/00

[52] U.S. Cl. ..... 4/307

[58] Field of Search ..... 4/302, 304, 305, 307, 4/312, DIG. 2, 301

[56] References Cited

U.S. PATENT DOCUMENTS

| | | | |
|---|---|---|---|
| 134,315 | 12/1872 | Robinson | 4/5 |
| 1,234,643 | 7/1917 | Doyle | 4/5 |
| 1,660,260 | 2/1928 | Diago | 4/307 |
| 2,678,450 | 5/1954 | Simpson et al. | 4/312 |
| 3,412,408 | 11/1968 | Michal, Jr. | 4/99 |
| 3,500,480 | 3/1970 | Michal, Jr. | 4/102 |
| 3,742,522 | 7/1973 | Stevenson | 4/307 |
| 4,138,748 | 2/1979 | Zielinski | 4/312 |
| 4,309,781 | 1/1982 | Lissau | 4/304 |
| 4,488,321 | 12/1984 | Brunton | 4/301 |
| 4,540,321 | 10/1985 | Douillard | 4/301 |

FOREIGN PATENT DOCUMENTS

| | | | |
|---|---|---|---|
| 2541547 | 3/1977 | Fed. Rep. of Germany | 4/307 |
| 2839242 | 3/1980 | Fed. Rep. of Germany | 4/307 |
| 3347977 | 1/1986 | Fed. Rep. of Germany | 4/307 |
| 3631748 | 4/1988 | Fed. Rep. of Germany | 4/307 |

OTHER PUBLICATIONS

#2791780 Benton Ellis Krischer, Urinal Training Device for Little Boys, Patented 5/14/1957, p. 227, Cl 4–1, Ser. No. 434,721.

*Primary Examiner*—Charles E. Phillips

*Attorney, Agent, or Firm*—George C. Limbach

[57] ABSTRACT

An automatically concealed urinal housed in a cabinet which can be mounted on the wall, semi- or fully recessed in the wall or located under counter or in another suitable location. The urinal becomes operative when a person stands in front of urinal at a distance of one or more feet, which action activates the sensor placed in the wall above the cabinet, simultaneously causing the door or doors to open on the cabinet and the urinal bowl which is on a support structure will tilt forward at an approximate angle of 15°, more or less, at which time the flushing fluid is directed to the urinal bowl by a hydraulic actuator, thoroughly flushing bowl interior as long as bowl is in use. Waste fluid along with flushing fluid will follow a preferred path through support structure to the sewer connection. Urinal will return to cabinet with doors closing automatically when individual steps away from predetermined position. Urinal can also be manually positioned and preset in a fixed position. Adjustment means permits lowering or raising upper support section, if necessary.

2 Claims, 1 Drawing Sheet

AUTOMATICALLY CONCEALED URINAL

BACKGROUND

1. Field Of Invention

This invention relates to urinals for males, specifically to automatically concealed urinals for bathrooms, restrooms, or wherever facilities for males are required.

2. Description Of Prior Art

There have been a variety of urinals proposed for both home and public facility. Following are some examples:

One of the prior art patents is U.S. Pat. No. 4,488,321, 12/18/84, to B. Brunton, which discloses an opening cut in wall for a receptacle attached to a waste pipe, with a flushing means and door to cover opening. Brunton's design is also called a concealed urinal, but is entirely different in concept from the preferred embodiment of this invention.

U.S. Pat. No. 4,549,321, 10/29/85, to R. Douillard, is comprised of intricate metal works attached to an ordinary toilet seat lid, requiring the use of hands to position operationally, and to return the gears, levers and urinal to a flattened position against underside of lid. This concept does not relate to the automatic urinal, which can be preset, if necessary, but which operates without handling urinal device in most instances.

OBJECTS AND ADVANTAGES

Accordingly I claim the following as the objects and advantages of my invention to make the male urinal a sanitary and efficient device for the home bathrooms, restrooms or wherever male facilities are required. With the automatic opening and closing of doors, and the automatic flushing and retraction of the device into cabinet, there is no need for use of human hands for the operation and use of urinal, in most instances. If adjustment of height is required raising or lowering can be done in a moment through an adjustment means on tubular support structure. The urinal can be rigidly preset, eliminating the raising or lowering adjustment.

The thorough flushing of bowl and sustaining tubular understructure leaves the device odor free and in a sanitary condition after each use.

As recited by other urinal inventions, the objectionable splashing onto clothing and surrounding surfaces, coupled with noise created by use of the standard toilet bowls, has created a very real need for solutions to these unsanitary and annoying aspects of the present day bathrooms and male facilities.

This invention is designed to bring the urinal solution to the present-day bathrooms and male facilities. Installation can be semi- or fully recessed flush with wall, against wall, under cabinets or other suitable locations in presently built structures and in newly designed bathrooms.

There has been a need for proper facilities for males from ages six to the oldest since the creation of the first bathroom.

DRAWING FIGURES

FIG. 1 shows a perspective view of urinal bowl in a tilted position ready for use, and in phantom, the position of urinal when not in use, stored in cabinet.

Drawing Reference Numerals

20—Urinal bowl

Figure 1:
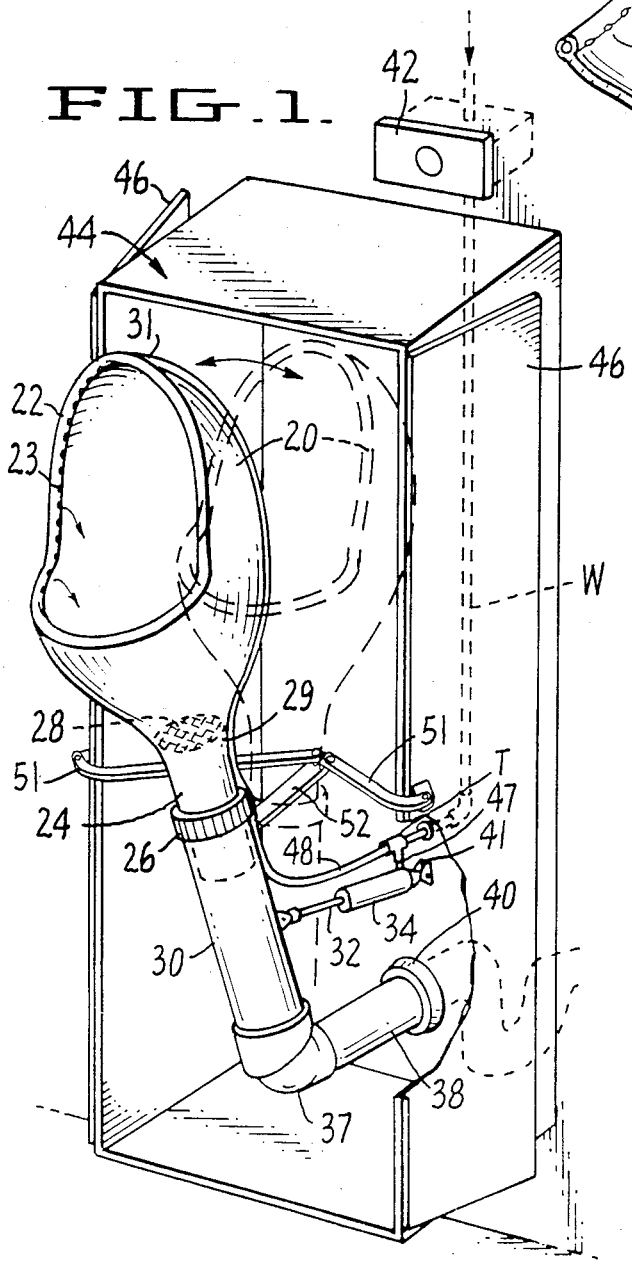
FIG. 1 is an overall view of automatic urinal with cabinet.

22—Inner rim of bowl for manifold rinsing system FIG. 1

23—Manifold rinsing system incorporated in inner rim

24—Tubular support section at base of urinal bowl 20

26—Point of adjustment means for different heights

Figure 2:
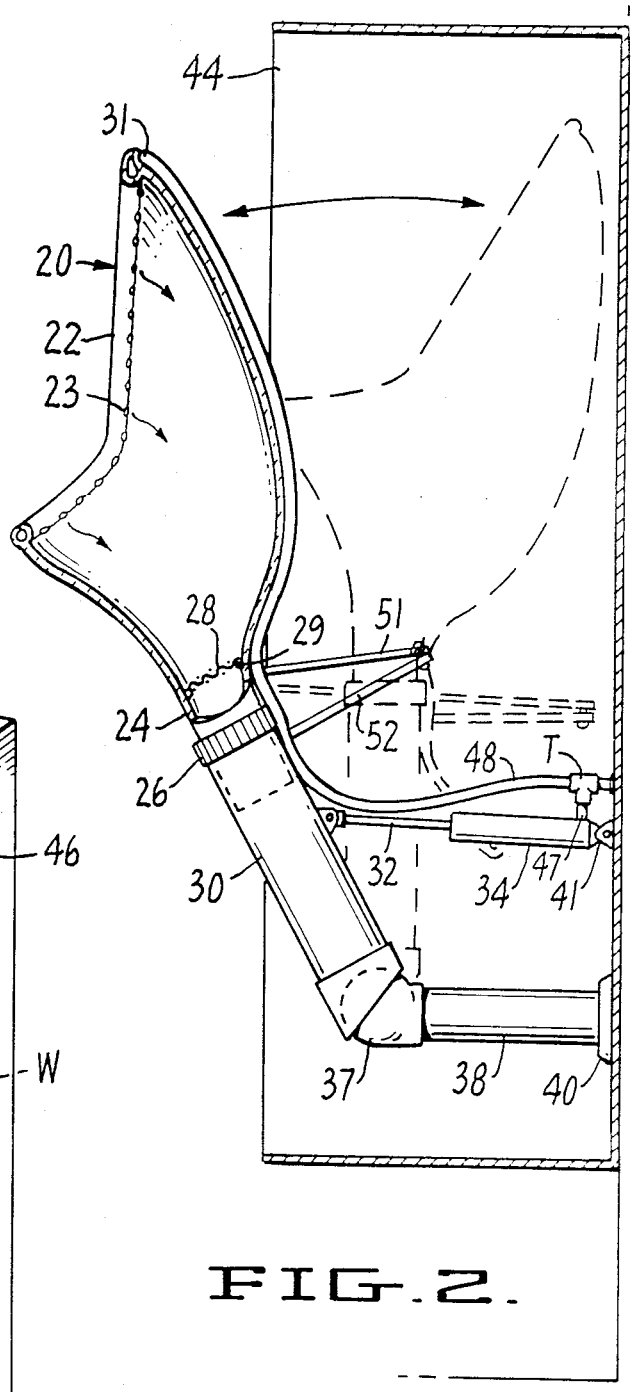
FIG. 2 is a side view of urinal extended from cabinet as shown in FIG. 1, showing position of urinal when stored, in phantom.

28—Removable screen as shown in FIG. 2

29—Slight inner ridge to hold removable screen

30—Upper tubular support section including pivotal joint 37

31—Path of rinse fluid from line 48 leading from actuator means

32—Piston shaft as shown in FIGS. 1 and 2 of actuator means

34—Piston housing as shown in FIGS. 1 and 2 of actuator means

Figure 3:
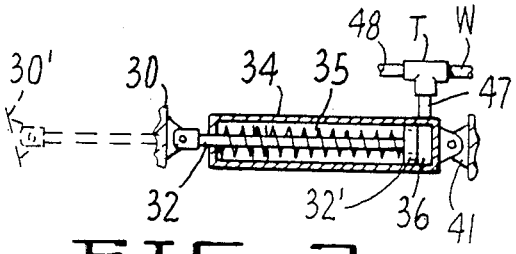
FIG. 3 is an enlarged sectional view of the actuator portion of tubular section 30 shown in FIGS. 1 and 2.

35—Spring in actuator means in FIG. 3

36—Fluid compartment in actuator means in FIG. 3

37—Pivotal joint as shown in FIGS. 1 and 2

38—Lower tubular support section connected to sewer outlet, FIG. 1

40—Collar for tubular section 38 connected to sewer outlet

41—Fasteners for piston shaft shown in FIGS. 1 and 2

42—Sensor with plate as shown in FIG. 1, not part of this invention

44—Cabinet for urinal

46—Doors for cabinet 44

47—Fluid line from T to actuator as shown in FIG. 3

48—Fluid line carrying fluid from T to Path 31 and urinal bowl

51—Movable metal arms which open and close cabinet doors

52—Metal plate which supports metal arms operating doors

T—Fluid line W is divided at T supplying lines 47 and 48

W—Major flushing fluid line which operates system

DETAILED DESCRIPTION OF THE INVENTION

Referring to FIG. 1 there is shown a urinal in accordance with the preferred embodiment of this invention including a housing or cabinet 44 mounted on the wall, but which can be semi- or fully recessed in the wall or located next to wall, under a counter, or in other suitable location. The urinal includes urinal bowl 20 of elliptical or other suitable shape with a hollow rim 22 containing openings 23 which direct flushing fluid over the inner sides of the bowl and which is delivered to the bowl from fluid line 31 in the manner described in greater detail below.

The lower end of bowl 20 includes tubular support section 24 which is connected to upper tubular support section 30, thence to pivotal joint 37 which connects upper 30 and lower 38 tubular support sections. At the lower end of tubular support section 24 which fits into tubular support section 30, 26, a threaded collar performs as a clamping device for the purpose of raising or lowering the urinal bowl to accommodate males of different heights. At the neck of the urinal bowl where it becomes tubular support section 24 a slight interior ridge 29 is provided to sustain a removable screen for the purpose of keeping trash from being deposited in the tubular support sections.

Apparatus is provided for movement of the urinal bowl 20 between a vertical position when stored in cabinet and an angularly tilted position when extended outside the cabinet for use. The pivotal joint 37 enables the upper tubular section 30 to be in a vertical position inside cabinet and at an extended position of approximately 15°, more or less, when tilted forward for use. The lower drain tubular support section 38 is positioned horizontally to the floor of the cabinet and connected at one end to the pivotal joint 37 and at the other end via a collar 40 to the sewer outlet, not shown except in phantom.

An actuator 34 is provided in the form of a cylindrical housing having a piston 32', connected to a piston rod 32, the free end of which is appropriately connected to the tubular support structure such as to a boss 30' on the upper tubular support section 30. The actuator housing 34 is connected via a boss 41 to a rear panel of the cabinet 44. The actuator 34 includes spring 35 urging the piston rod 32 into the actuator 34 and pulling the urinal into substantially the vertical position within the cabinet 44.

Flushing fluid from fluid line W can be used both to operate the actuator and to provide flushing fluid to urinal bowl 20. FIG. 1 shows the flushing fluid line W connected to a T and via flushing fluid line 48 to fluid line 30 and via flushing fluid line 47 which connects to chamber 36 and actuator 34 on the side of the piston 32' opposite the spring 35. Electronic means 42 can be provided on the wall to both sense the presence of a person at a designated position in front of cabinet 44 and open a valve allowing fluid to flow through line W into the actuator chamber 36 to move the urinal from vertical to tilt position and into fluid path 31 for flushing the urinal bowl and tubular support sections. The electronic means 42 can be of various types such as ultrasonic, infrared, etc., or can operate in conjunction with a pressure sensor positioned at the appropriate location on the floor in front of cabinet 44.

Cabinet 44 with one or more doors 46, according to the embodiment of this invention, are each connected to an actuating arm 51 which is connected to mounting arm 52 on lower tubular section 30 near division 26 with adjustment means. The doors 46 are actuated by action of electronic means 42. As the urinal is moved from a vertical position to a forward tilting position the arms 51 swing the doors open. Similarly doors 46 are swung closed as person moves away from urinal and the urinal is moved from a tilted position back to a vertical stored position in cabinet 44.

In summary, the urinal shown in FIGS. 1 and 2 can be a free standing device with or without cabinet 44. The preferred embodiment of this invention is that of a urinal housed in cabinet 44, which can be semi- or fully recessed flush with the wall, under counter, or other convenient location. When an individual stands in front of the urinal at a distance of one or more feet the electronic means 42 is activated moving actuator 34 into operative procedures. Actuator 34 moves the urinal outward which opens the cabinet doors 46 letting the urinal device tilt forward at a 15° angle, more or less. Simultaneously the automatic flushing system is activated causing the rinsing fluid to flow through the inner rim 22 of bowl which is designed to assist flow of rinse fluid through small holes 23 on underside of rim following the circumference of bowl 20, thoroughly rinsing the inside of bowl and continuing until the individual steps away from urinal device, at which time the rinsing fluid will cease flowing and the urinal device will return to its stored position, thoroughly rinsed and odor free, the waste water with flushing fluid having followed a preferred path through the tubular support structure to the sewer outlet.

The outwardly tilted position of the urinal bowl when ready for use provides the maximum protection against misdirection, spillage and/or spatter of urine.

While the invention has been described and illustrated in its several preferred embodiments, it should be understood that the invention is not to be limited to the precise details herein illustrated and described since the same may be carried out in other ways falling within the scope of the invention as claimed.

I claim:

1. An automatic urinal stored in a cabinet including in combination:

a cabinet with at least one door which opens and closes through use of an electronic operator means;

a urinal bowl mounted on a tubular support structure and communicating with a sewer via said support structure;

said urinal bowl, when stored, being located in a vertical position inside said cabinet, said urinal bowl movable to a position outside said cabinet with said door open, said use position causing said urinal bowl and said tubular support structure to be tilted outwardly from said cabinet to an angular position of substantially 15° with respect to a vertical plane;

said support structure including a tubular support section extending from the base of said urinal bowl being telescopically mounted in an upper tubular support section;

said upper support section being coupled to a pivoting joint for connecting said urinal bowl to said sewer;

said telescopic mount operating to raise and lower said urinal bowl for males of different heights;

fluid actuated moving means activated by said electronic operator means and coupled with said upper tubular support section for moving said urinal bowl from said vertical position to said tilted position in response to operation of said electronic operator means;

means for activating said electronic operator means to operate said moving means to move said urinal bowl from vertical to tilted position when a person moves into a predetermined position in front of said urinal, said moving means returning said tilted urinal to vertical position within said cabinet when said person moves away from said predetermined position; and means for supplying flushing fluid into said urinal bowl simultaneously with opening of said door and movement of said angularly tilted urinal bowl to said use position.

2. The urinal of claim 1 wherein said cabinet includes two doors opened through said moving means when said bowl moves to said tilted position and closed when said urinal bowl returns to a vertical position within said cabinet.

* * * * *